US009191752B2

(12) United States Patent
Theverapperuma et al.

(10) Patent No.: US 9,191,752 B2
(45) Date of Patent: Nov. 17, 2015

(54) ENTRAINMENT AVOIDANCE WITH AN AUTO REGRESSIVE FILTER

(71) Applicant: Starkey Laboratories, Inc., Eden Prairie, MN (US)

(72) Inventors: Lalin Theverapperuma, Cupertino, CA (US); Harikrishna P. Natarajan, Shakopee, MN (US); Arthur Salvetti, Colorado Springs, CO (US); Jon S. Kindred, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/223,669

(22) Filed: Mar. 24, 2014

(65) Prior Publication Data

US 2014/0348361 A1 Nov. 27, 2014

Related U.S. Application Data

(63) Continuation of application No. 11/877,567, filed on Oct. 23, 2007, now Pat. No. 8,681,999.

(60) Provisional application No. 60/862,526, filed on Oct. 23, 2006.

(51) Int. Cl.
*H04R 25/00* (2006.01)

(52) U.S. Cl.
CPC ..... *H04R 25/453* (2013.01); *H04R 2460/01* (2013.01)

(58) Field of Classification Search
CPC ..... H04R 3/005; H04R 25/407; H04R 25/00; H04R 2225/43; H04R 25/505; H04R 2225/41; H04R 25/30
See application file for complete search history.

(56) References Cited

U.S. PATENT DOCUMENTS

| | | | |
|---|---|---|---|
| 3,601,549 | A | 8/1971 | Mitchell |
| 4,176,252 | A | 11/1979 | Dutkovich |
| 4,495,643 | A | 1/1985 | Orban |
| 4,731,850 | A | 3/1988 | Levitt et al. |
| 4,783,817 | A | 11/1988 | Hamada et al. |
| 4,879,749 | A | 11/1989 | Levitt et al. |
| 4,985,925 | A | 1/1991 | Langberg et al. |

(Continued)

FOREIGN PATENT DOCUMENTS

| | | | |
|---|---|---|---|
| DE | 19748079 | A1 | 5/1999 |
| EP | 0585976 | A2 | 3/1994 |

(Continued)

OTHER PUBLICATIONS

"Advance Adaptive Feedback Cancellation", IntriCon: Technology White Paper, [Online]. Retrieved from the Internet: <URL: http://www.intricondownloads.com/D1/techdemo/WP_Advanced_AFC_rev101006.pdf>, (Oct. 10, 2005), 3 pgs.

(Continued)

*Primary Examiner* — David Vu
*Assistant Examiner* — Cuong Nguyen
(74) *Attorney, Agent, or Firm* — Schwegman Lundberg & Woessner, P.A.

(57) ABSTRACT

A method of signal processing an input signal in a hearing aid to avoid entrainment, the hearing aid including a receiver and a microphone, the method comprising using an adaptive filter to measure an acoustic feedback path from the receiver to the microphone and adjusting an adaptation rate of the adaptive filter using an output from a filter having an autoregressive portion, the output derived at least in part from a ratio of a predictive estimate of the input signal to a difference of the predictive estimate and the input signal.

16 Claims, 5 Drawing Sheets

(56) References Cited

U.S. PATENT DOCUMENTS

| | | | | |
|---|---|---|---|---|
| 5,016,280 | A | 5/1991 | Engebretson et al. | |
| 5,027,410 | A | 6/1991 | Williamson et al. | |
| 5,276,739 | A | 1/1994 | Krokstad et al. | |
| 5,402,496 | A | 3/1995 | Soli et al. | |
| 5,502,869 | A | 4/1996 | Smith et al. | |
| 5,533,120 | A | 7/1996 | Staudacher | |
| 5,619,580 | A | 4/1997 | Hansen | |
| 5,621,802 | A | 4/1997 | Harjani et al. | |
| 5,668,747 | A | 9/1997 | Ohashi | |
| 6,072,884 | A | 6/2000 | Kates | |
| 6,173,063 | B1 | 1/2001 | Melanson | |
| 6,356,606 | B1 | 3/2002 | Hahm | |
| 6,389,440 | B1 | 5/2002 | Lewis et al. | |
| 6,434,246 | B1 | 8/2002 | Kates et al. | |
| 6,434,247 | B1 | 8/2002 | Kates et al. | |
| 6,480,610 | B1 | 11/2002 | Fang et al. | |
| 6,494,247 | B1 | 12/2002 | Pedone | |
| 6,552,446 | B1 | 4/2003 | Lomba et al. | |
| 6,563,931 | B1 | 5/2003 | Soli et al. | |
| 6,754,356 | B1 | 6/2004 | Luo et al. | |
| 6,831,986 | B2 | 12/2004 | Kates | |
| 7,058,182 | B2 | 6/2006 | Kates | |
| 7,065,486 | B1 * | 6/2006 | Thyssen | 704/227 |
| 7,155,018 | B1 | 12/2006 | Stokes, III et al. | |
| 7,519,193 | B2 | 4/2009 | Fretz | |
| 7,809,150 | B2 * | 10/2010 | Natarajan et al. | 381/318 |
| 7,995,780 | B2 | 8/2011 | Pedersen et al. | |
| 8,116,473 | B2 | 2/2012 | Salvetti et al. | |
| 8,199,948 | B2 | 6/2012 | Theverapperuma | |
| 8,452,034 | B2 | 5/2013 | Theverapperuma | |
| 8,509,465 | B2 | 8/2013 | Theverapperuma et al. | |
| 8,553,899 | B2 | 10/2013 | Salvetti et al. | |
| 8,634,576 | B2 | 1/2014 | Salvetti et al. | |
| 8,681,999 | B2 * | 3/2014 | Theverapperuma et al. | 381/66 |
| 8,744,104 | B2 | 6/2014 | Theverapperuma | |
| 8,929,565 | B2 | 1/2015 | Salvetti et al. | |
| 2003/0026442 | A1 | 2/2003 | Fang et al. | |
| 2003/0031314 | A1 | 2/2003 | Tanrikulu et al. | |
| 2003/0185411 | A1 | 10/2003 | Atlas et al. | |
| 2004/0086137 | A1 | 5/2004 | Yu et al. | |
| 2004/0125973 | A1 | 7/2004 | Fang et al. | |
| 2005/0036632 | A1 | 2/2005 | Natarajan et al. | |
| 2005/0047620 | A1 | 3/2005 | Fretz | |
| 2006/0140429 | A1 | 6/2006 | Klinkby et al. | |
| 2007/0223755 | A1 | 9/2007 | Salvetti et al. | |
| 2008/0095388 | A1 | 4/2008 | Theverapperuma | |
| 2008/0095389 | A1 | 4/2008 | Theverapperuma | |
| 2008/0130926 | A1 | 6/2008 | Theverapperuma | |
| 2008/0130927 | A1 | 6/2008 | Theverapperuma et al. | |
| 2009/0175474 | A1 | 7/2009 | Salvetti et al. | |
| 2011/0091049 | A1 | 4/2011 | Salvetti et al. | |
| 2011/0116667 | A1 | 5/2011 | Natarajan et al. | |
| 2012/0230503 | A1 | 9/2012 | Theverapperuma | |
| 2014/0098967 | A1 | 4/2014 | Salvetti et al. | |

FOREIGN PATENT DOCUMENTS

| | | | |
|---|---|---|---|
| EP | 1367857 | A1 | 12/2003 |
| EP | 1718110 | A1 | 2/2006 |
| EP | 2080408 | B1 | 8/2012 |
| EP | 1835708 | B1 | 5/2013 |
| WO | WO-0106746 | A2 | 1/2001 |
| WO | WO-0106812 | A1 | 1/2001 |
| WO | WO-0110170 | A2 | 2/2001 |
| WO | WO-2004105430 | A1 | 12/2004 |
| WO | WO-2008051569 | A2 | 5/2008 |
| WO | WO-2008051569 | A3 | 5/2008 |
| WO | WO-2008051570 | A1 | 5/2008 |
| WO | WO-2008051571 | A1 | 5/2008 |

OTHER PUBLICATIONS

"U.S. Appl. No. 10/857,599, Final Office Action mailed Jun. 11, 2009", 7 pgs.
"U.S. Appl. No. 10/857,599, Final Office Action Mailed Jul. 24, 2008", 9 pgs.
"U.S. Appl. No. 10/857,599, Non-Final Office Action mailed Jan. 26, 2010", 8 pgs.
"U.S. Appl. No. 10/857,599, Non-Final Office Action mailed Dec. 26, 2007", 8 pgs.
"U.S. Appl. No. 10/857,599, Non-Final Office Action mailed Dec. 31, 2008", 6 pgs.
"U.S. Appl. No. 10/857,599, Notice of Allowance mailed Jul. 26, 2010", 10 pgs.
"U.S. Appl. No. 10/857,599, Response filed Apr. 26, 2010 to Non Final Office Action mailed Jan. 26, 2010", 8 pgs.
"U.S. Appl. No. 10/857,599, Response filed Apr. 28, 2008 to Non-Final Office Action mailed Dec. 26, 2007", 7 pgs.
"U.S. Appl. No. 10/857,599, Response filed Apr. 30, 2009 to Non-Final Office Action mailed Dec. 31, 2008", 7 pgs.
"U.S. Appl. No. 10/857,599, Response filed Nov. 12, 2009 to Final Office Action mailed Jun. 11, 2009", 9 pgs.
"U.S. Appl. No. 10/857,599, Response filed Nov. 16, 2007 to Restriction Requirement mailed May 21, 2007", 6 pgs.
"U.S. Appl. No. 10/857,599, Response filed Nov. 24, 2008 to Final Office Action mailed Jul. 24, 2008", 9 pgs.
"U.S. Appl. No. 10/857,599, Restriction Requirement mailed May 21, 2007", 5 pgs.
"U.S. Appl. No. 11/276,763, Decision on Pre-Appeal Brief Request mailed Feb. 15, 2011", 3 pgs.
"U.S. Appl. No. 11/276,763, Final Office Action mailed Sep. 14, 2010", 9 pgs.
"U.S. Appl. No. 11/276,763, Non-Final Office Action mailed Apr. 2, 2010", 11 pgs.
"U.S. Appl. No. 11/276,763, Notice of Allowance mailed Aug. 25, 2011", 8 pgs.
"U.S. Appl. No. 11/276,763, Notice of Allowance mailed Oct. 11, 2011", 8 pgs.
"U.S. Appl. No. 11/276,763, Pre-Appeal Brief Request filed Jan. 14, 2011", 5 pgs.
"U.S. Appl. No. 11/276,763, Response filed Jan. 11, 2010 to Restriction Requirement mailed Dec. 10, 2009", 9 pgs.
"U.S. Appl. No. 11/276,763, Response filed Jun. 15, 2011 to Final Office Action mailed Sep. 14, 2010 and Decision on Pre-Appeal Brief mailed Feb. 15, 2011", 10 pgs.
"U.S. Appl. No. 11/276,763, Response filed Jul. 2, 2010 to Non Final Office Action mailed Apr. 2, 2010", 15 pgs.
"U.S. Appl. No. 11/276,763, Restriction Requirement mailed Dec. 10, 2009", 6 pgs.
"U.S. Appl. No. 11/877,317, Non Final Office Action mailed Aug. 18, 2011", 16 pgs.
"U.S. Appl. No. 11/877,317, Notice of Allowance mailed Jan. 31, 2013", 8 pgs.
"U.S. Appl. No. 11/877,317, Notice of Allowance mailed Jun. 1, 2012", 12 pgs.
"U.S. Appl. No. 11/877,317, Notice of Allowance mailed Sep. 17, 2012", 8 pgs.
"U.S. Appl. No. 11/877,317, Response filed Feb. 20, 2012 to Non Final Office Action mailed Aug. 18, 2011", 9 pgs.
"U.S. Appl. No. 11/877,567, Examiner Interview Summary mailed May 31, 2012", 1 pgs.
"U.S. Appl. No. 11/877,567, Non Final Office Action mailed Sep. 1, 2011", 17 pgs.
"U.S. Appl. No. 11/877,567, Notice of Allowance mailed Apr. 12, 2013", 9 pgs.
"U.S. Appl. No. 11/877,567, Notice of Allowance mailed May 31, 2012", 11 pgs.
"U.S. Appl. No. 11/877,567, Notice of Allowance mailed Sep. 28, 2012", 8 pgs.
"U.S. Appl. No. 11/877,567, Notice of Allowance mailed Nov. 14, 2013", 10 pgs.
"U.S. Appl. No. 11/877,567, Response filed Mar. 1, 2012 to Non Final Office Action mailed Sep. 1, 2011", 11 pgs.
"U.S. Appl. No. 11/877,605, Final Office Action mailed Apr. 9, 2012", 17 pgs.
"U.S. Appl. No. 11/877,605, Non Final Office Action mailed Sep. 27, 2011", 12 pgs.

(56) References Cited

OTHER PUBLICATIONS

"U.S. Appl. No. 11/877,605, Non Final Office Action mailed Nov. 20, 2012", 8 pgs.
"U.S. Appl. No. 11/877,605, Notice of Allowance mailed Apr. 10, 2013", 11 pgs.
"U.S. Appl. No. 11/877,605, Response filed Jan. 27, 2012 to Non Final Office Action mailed Sep. 27, 2011", 10 pgs.
"U.S. Appl. No. 11/877,605, Response filed Mar. 20, 2013 to Non Final Office Action mailed Nov. 20, 2013", 8 pgs.
"U.S. Appl. No. 11/877,605, Response filed Jul. 9, 2012 to Final Office Action mailed Apr. 9, 2012", 9 pgs.
"U.S. Appl. No. 11/877,606, Examiner Interview Summary mailed Feb. 8, 2012", 1 pg.
"U.S. Appl. No. 11/877,606, Final Office Action mailed Dec. 2, 2011", 11 pgs.
"U.S. Appl. No. 11/877,606, Non Final Office Action mailed Jun. 10, 2011", 12 pgs.
"U.S. Appl. No. 11/877,606, Notice of Allowance mailed Feb. 15, 2012", 10 pgs.
"U.S. Appl. No. 11/877,606, Response filed Feb. 2, 2012 to Final Office Action mailed Dec. 2, 2011", 9 pgs.
"U.S. Appl. No. 11/877,606, Response filed Sep. 12, 2011 to Non-Final Office Action mailed Jun. 10, 2011", 7 pgs.
"U.S. Appl. No. 12/336,460, Advisory Action mailed Jul. 30, 2012", 3 pgs.
"U.S. Appl. No. 12/336,460, Final Office Action mailed Apr. 27, 2012", 8 pgs.
"U.S. Appl. No. 12/336,460, Non Final Office Action mailed Sep. 29, 2011", 13 pgs.
"U.S. Appl. No. 12/336,460, Non Final Office Action mailed Nov. 26, 2012", 6 pgs.
"U.S. Appl. No. 12/336,460, Notice of Allowance mailed May 10, 2013", 9 pgs.
"U.S. Appl. No. 12/336,460, Response filed Jan. 30, 2012 to Non Final Office Action mailed Sep. 29, 2011", 25 pgs.
"U.S. Appl. No. 12/336,460, Response filed Apr. 26, 2013 to Non final Office Action mailed Nov. 26, 2012", 8 pgs.
"U.S. Appl. No. 12/336,460, Response filed Jun. 27, 2012 to Final Office Action mailed Apr. 27, 2012", 10 pgs.
"U.S. Appl. No. 12/336,460, Supplemental Notice of Allowability mailed Sep. 13, 2013", 2 pgs.
"U.S. Appl. No. 12/875,646, Final Office Action mailed Oct. 25, 2012", 10 pgs.
"U.S. Appl. No. 12/875,646, Non Final Office Action mailed Jan. 30, 2012", 4 pgs.
"U.S. Appl. No. 12/875,646, Non Final Office Action mailed May 10, 2013", 9 pgs.
"U.S. Appl. No. 12/875,646, Response filed Apr. 25, 2013 to Final Office Action mailed Oct. 25, 2012", 9 pgs.
"U.S. Appl. No. 12/875,646, Response filed Jul. 30, 2012 to Non Final Office Action mailed Jan. 30, 2012", 7 pgs.
"U.S. Appl. No. 12/875,646, Response filed Oct. 10, 2013 to Non Final Office Action mailed May 10, 2013", 11 pgs.
"U.S. Appl. No. 12/980,720, Non Final Office Action mailed Dec. 14, 2012", 10 pgs.
"U.S. Appl. No. 12/980,720, Notice of Allowance mailed May 29, 2013", 8 pgs.
"U.S. Appl. No. 12/980,720, Notice of Allowance mailed Sep. 11, 2013", 8 pgs.
"U.S. Appl. No. 12/980,720. Response filed May 14, 2013 to Non Final Office Action mailed Dec. 14, 2013", 8 pgs.
"U.S. Appl. No. 13/478,570, Non Final Office Action mailed Aug. 13, 2013", 7 pgs.
"U.S. Appl. No. 13/478,570, Notice of Allowance mailed Jan. 21, 2014", 5 pgs.
"U.S. Appl. No. 13/478,570, Response filed Nov. 13, 2013 to Non Final Office Action mailed Aug. 13, 2013", 10 pgs.
"Entrainment (Physics)", [Online]. Retrieved from the Internet: <URL: http://en.wikipedia.org/w/index.php?title=Entrainment_(physics)&printable=yes>, (Accessed Jun. 18, 2009), 2 pgs.
"European Application Serial No. 07839766.8, Office Action mailed Jun. 8, 2009", 2 pgs.
"European Application Serial No. 07839766.8, Office Action mailed Jul. 2, 2009", 2 pgs.
"European Application Serial No. 07839766.8, Office Action mailed Sep. 17, 2012", 10 pgs.
"European Application Serial No. 07250899.7, Extended European Search Report mailed May 15, 2008", 7 pgs.
"European Application Serial No. 07250899.7, Office Action Mailed Jan. 15, 2009", 1 pgs.
"European Application Serial No. 07250899.7, Office Action mailed Mar. 21, 2011", 3 pgs.
"European Application Serial No. 07250899.7, Response filed Jul. 13, 2009 to Office Action mailed Jan. 15, 2009", 17 pgs.
"European Application Serial No. 07839766.8, Response filed Jan. 11, 2013 to Office Action mailed Sep. 17, 2012", 16 pgs.
"European Application Serial No. 07839767.6, Office Action mailed Mar. 8, 2012", 27 pgs.
"European Application Serial No. 07839767.6, Amendment filed Jun. 2, 2011", 11 pgs.
"European Application Serial No. 07839767.6, Decision to Grant mailed Jul. 19, 2012", 2 pgs.
"European Application Serial No. 07839767.6, Office Action mailed May 5, 2011", 4 pgs.
"European Application Serial No. 07839768.4, Office Action mailed Dec. 9, 2011", 3 pgs.
"European Application Serial No. 07839768.4, Response filed Apr. 5, 2012 to Office Action mailed Dec. 9, 2011", 20 pgs.
"Inspiria Ultimate—GA3285", [Online]. Retrieved from the Internet: <URL: http://www.sounddesigntechnologies.com/products_InspiriaUltimate.php>, (Accessed Jun. 18, 2009), 4 pgs.
"International Application Serial No. PCT/US2007/022548, International Preliminary Report on Patentability mailed May 7, 2009", 8 pgs.
"International Application Serial No. PCT/US2007/022548, Search Report mailed Jun. 3, 2008", 7 pgs.
"International Application Serial No. PCT/US2007/022548, Written Opinion mailed Jun. 3, 2008", 8 pgs.
"International Application Serial No. PCT/US2007/022549, International Preliminary Report on Patentability mailed May 7, 2009", 8 pgs.
"International Application Serial No. PCT/US2007/022549, International Search Report and Written Opinion mailed Feb. 15, 2008", 12 pgs.
"International Application Serial No. PCT/US2007/022550, International Preliminary Report on Patentability mailed May 7, 2009", 8 pgs.
"International Application Serial No. PCT/US2007/022550, International Search Report and Written Opinion mailed Oct. 23, 2006", 12 pgs.
Beaufays, Francoise, "Transform-Domain Adaptive Filters: An Analytical Approach", IEEE Trans. on Signal Proc., vol. 43(2), (Feb. 1995), 422-431.
Chankawee, A., et al., "Performance improvement of acoustic feedback cancellation in hearing aids using liner prediction", Digital Signal Processing Research Laboratory(DSPRL), (Nov. 21, 2004), 116-119.
Haykin, Simon, "Adaptive Filter Theory: 3rd Edition", Prentice Hall, (1996), 3 pgs.
Haykin, Simon, "Adaptive Filter Theory: Third Edition: Appendix G Gradient Adaptive Lattice Algorithm", Prentice Hall, (1996), 5 pgs.
Jenkins, W. Kenneth, et al., "Chapter 22—Transform Domain Adaptive Filtering", The Digital Signal Processing Handbook, Editors, Vijay K. Madisetti, Douglas B. Williams; Boca Raton, FL:CRC Press, (1998), 22-1-22-20.
Maxwell, J. A., et al., "Reducing Acoustic Feedback in Hearing Aids", IEEE Transactions on Speech and Audio Processing, 3(4), (Jul. 1995), 304-313.
Proakis, J. G, et al., "Digital Signal Processing", Prentice-Hall, Inc., XP002481168, (1996), 5 pgs.
Rife, D., et al., "Transfer-Function Measurement With Maximum-Length Sequences", J. Audio Eng. Soc., 37(6), (1989), 419-444.

(56) References Cited

OTHER PUBLICATIONS

Spreiet, Ann, et al., "Adaptive Feedback Cancellation in Hearing Aids With Linear Prediction of the Desired Signal", IEEE Transactions on Signal Processing 53(10), (Oct. 2005), 3749-3763.
Theverapperuma, Lalin S, et al., "Adaptive Feedback Canceller: Entrainment", Digital Signal Processing Workshop, 4th IEEE, PI, (Sep. 1, 2006), 245-250.
Theverapperuma, Lalin S, et al., "Continuous Adaptive Feedback Canceller Dynamics", Circuits and Systems, MWSCAS 2006. 49th IEEE International Midwest Symposium on Circuits and Systems, (Aug. 1, 2006), 605-609.
Theverapperurna, Lalin S, et al., "Adaptive Feedback Canceller: Entrainment", Digital Signal Processing Workshop, 12th—Signal Processing Education Workshop, 4th, IEEE, (2006), 245-250.
Wong, T.W., et al., "Adaptive Filtering Using Hartley Transform and Overlap-Saved method", IEEE Transaction on Signal Processing, Voi. 39, No. 7, (Jul. 1991), 1708-1711.
"U.S. Appl. No. 10/857,599, Examiner Interview Summary Jul. 16, 2010", 1 pgs.
"U.S. Appl. No. 11/877,317, Examiner Interview Summary mailed Jun. 1, 2012", 1 pgs.
"U.S. Appl. No. 11/877,605, Examiner Interview Summary mailed Apr. 10, 2013", 1 pgs.
"U.S. Appl. No. 12/875,646, Advisory Action mailed Mar. 2, 2015", 2 pgs.
"U.S. Appl. No. 12/875,646, Advisory Action mailed May 19, 2014", 3 pgs.
"U.S. Appl. No. 12/875,646, Final Office Action mailed Feb. 25, 2014", 10 pgs.
"U.S. Appl. No. 12/875,646, Final Office Action mailed Oct. 24, 2014", 10 pgs.
"U.S. Appl. No. 12/875,646, Non Final Office Action mailed Jun. 25, 2014", 10 pgs.
"U.S. Appl. No. 12/875,646, Response filed Jan. 26, 2015 to Final Office Action mailed Oct. 24, 2014", 8 pgs.
"U.S. Appl. No. 12/875,646, Response filed Apr. 25, 2014 to Final Office Action mailed Feb. 25, 2014", 9 pgs.
"U.S. Appl. No. 12/875,646, Response filed Sep. 25, 2014 to Non Final Office Action mailed Jun. 25, 2014", 8 pgs.
"U.S. Appl. No. 14/105,269, Non Final Office Action mailed Mar. 13, 2014", 10 pgs.
"U.S. Appl. No. 14/105,269, Notice of Allowance mailed Aug. 21, 2014", 7 pgs.
"U.S. Appl. No. 14/105,269, Response Filed Jul. 14, 2014 to Non Final Office Action mailed Mar. 13, 2014", 7 pgs.
"U.S. Appl. No. 14/105,269, Supplemental Notice of Allowability mailed Sep. 15, 2014", 3 pgs.
"European Application Serial No. 07250899.7, response filed Sep. 5, 2011 to Office Action mailed Mar. 21, 2011", 25 pgs.
"European Application Serial No. 07839768.4, Examination Notification Art. 94(3) mailed Feb. 26, 2014", 6 pgs.
"European Application Serial No. 07839768.4, Examination Notification Art. 94(3) mailed Dec. 23, 2014", 4 pgs.
"European Application Serial No. 07839768.4, Response filed Jun. 20, 2014 to Office Action mailed Feb. 26, 2014", Jul. 20, 2014, 10 pgs.

* cited by examiner

ENTRAINMENT AVOIDANCE WITH AN AUTO REGRESSIVE FILTER

CLAIM OF PRIORITY AND RELATED APPLICATION

This application is a continuation of U.S. application Ser. No. 11/877,567, filed 23 Oct. 2007, now issued as U.S. Pat. No. 8,681,999, which application claims the benefit of priority under 35 U.S.C. 119(e) of U.S. Provisional Patent Application Ser. No. 60/862,526, filed Oct. 23, 2006, which applications are hereby incorporated by reference in their entirety.

TECHNICAL FIELD

The present subject matter relates generally to adaptive filters and in particular to method and apparatus to reduce entrainment-related artifacts for hearing assistance systems.

BACKGROUND

Digital hearing aids with an adaptive feedback canceller usually suffer from artifacts when the input audio signal to the microphone is periodic. The feedback canceller may use an adaptive technique, such as a N-LMS algorithm, that exploits the correlation between the microphone signal and the delayed receiver signal to update a feedback canceller filter to model the external acoustic feedback. A periodic input signal results in an additional correlation between the receiver and the microphone signals. The adaptive feedback canceller cannot differentiate this undesired correlation from that due to the external acoustic feedback and borrows characteristics of the periodic signal in trying to trace this undesired correlation. This results in artifacts, called entrainment artifacts, due to non-optimal feedback cancellation. The entrainment-causing periodic input signal and the affected feedback canceller filter are called the entraining signal and the entrained filter, respectively.

Entrainment artifacts in audio systems include whistle-like sounds that contain harmonics of the periodic input audio signal and can be very bothersome and occurring with day-to-day sounds such as telephone rings, dial tones, microwave beeps, instrumental music to name a few. These artifacts, in addition to being annoying, can result in reduced output signal quality. Thus, there is a need in the art for method and apparatus to reduce the occurrence of these artifacts and hence provide improved quality and performance.

SUMMARY

This application addresses the foregoing needs in the art and other needs not discussed herein. Methods and apparatus embodiments are provided to avoid entrainment of feedback cancellation filters in hearing assistance devices. Various embodiments include using a auto regressive unit with an adaptive filter to measure an acoustic feedback path and deriving an output of the auto regressive unit at least in part from a ratio of a predictive estimate of an input signal to a difference of the predictive estimate and the input signal. Various embodiments include using the ratio output of the auto regressive unit to adjust the adaptation rate of the adaptive feedback cancellation filter to avoid entrainment.

Embodiments are provided that include a microphone, a receiver and a signal processor to process signals received from the microphone, the signal processor including an adaptive feedback cancellation filter, the adaptive feedback cancellation filter adapted to provide an estimate of an acoustic feedback path for feedback cancellation. Embodiments are provided that also include a predictor filter to provide a power ratio of a predicted input signal error and a predicted input signal, the power ratio indicative of entrainment of the adaptive filter, wherein the predicted input signal error includes a measure of the difference between the predicted input signal and the first input signal.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their legal equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1A:
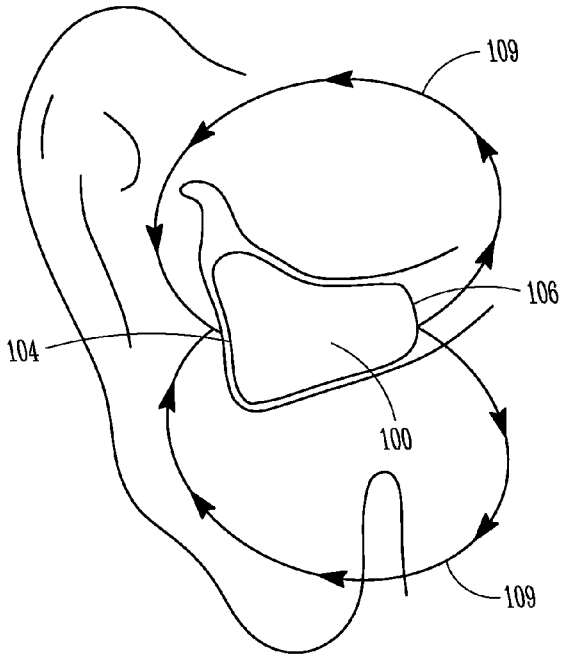
FIG. 1A is a diagram demonstrating, for example, an acoustic feedback path for one application of the present system relating to an in the ear hearing aid application, according to one application of the present system.

FIG. 1A is a diagram demonstrating, for example, an acoustic feedback path for one application of the present system relating to an in-the-ear hearing aid application, according to one application of the present system. In this example, a hearing aid 100 includes a microphone 104 and a receiver 106. The sounds picked up by microphone 104 are processed and transmitted as audio signals by receiver 106. The hearing aid has an acoustic feedback path 109 which provides audio from the receiver 106 to the microphone 104. It is understood that the invention may be applied to a variety of other systems, including, but not limited to, behind-the-ear systems, in-the-canal systems, completely in the canal systems and system incorporating prescriptive or improved hearing assistance programming and variations thereof.

Figure 1B:
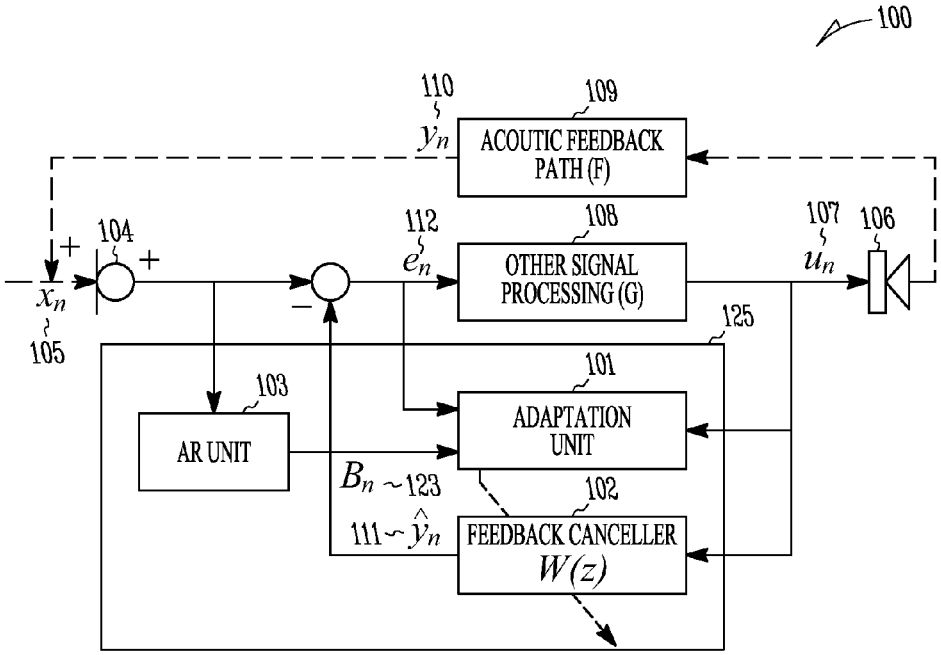
FIG. 1B illustrates a system with an adaptive feedback canceling apparatus, including an adaptation unit and a feedback canceller, and an auto regressive unit according to one embodiment of the present subject matter.

FIG. 1B illustrates a system 100, such as a hearing assistance device, with an adaptive feedback canceling apparatus 125, including an adaptation unit 101 and a feedback canceller 102, and an auto regressive unit 103 according to one embodiment of the present subject matter. FIG. 1B includes an input device 104 receiving a signal x(n) 105, an output device 106 sending a signal u(n) 107, a module for other processing and amplification 108, an acoustic feedback path 109 with an acoustic feedback path signal $y_n$ 110, an adaptive feedback cancellation filter 102 and an adaptation unit 101 for automatically adjusting the coefficients of the adaptive feedback cancellation filter. In various embodiments, the signal processing module 108 is used to amplify and process the acoustic signal, $e_n$ 112 as is common in Public Address (PA) systems, hearing aids, or other hearing assistance devices for example. In various embodiments, the signal processing module 108 includes prescriptive hearing assistance electronics such as those used in prescriptive hearing assistance devices. In various embodiments, the signal processing module includes an output limiter stage. The output limiting stage is used to avoid the output $u_n$ from encountering hard clipping. Hard clipping can result in unexpected behavior. In various embodiments, the physical receiver and gain stage limitations produce the desired clipping effect. Clipping is common during entrainment peaks and instabilities. During experimentation, a sigmoid clipping unit that is linear from −1 to 1 was used to achieve the linearity without affecting the functionality.

In the illustrated system, at least one feedback path 109 can contribute undesirable components 110 to the signal received at the input 104, including components sent from the output device 106. The adaptive feedback cancellation filter 102 operates to remove the undesirable components by recreating the transfer function of the feedback path and applying the output signal 107 to that function 102. A summing junction subtracts the replicated feedback signal $\hat{y}_n$ 111 from the input signal resulting in a error signal $e_n$ 112 closely approximating the intended input signal without the feedback components 110. In various embodiments, the adaptive feedback cancellation filter 102 initially operates with parameters set to cancel an assumed feedback leakage path. In many circumstances, the actual leakage paths vary with time. The adaptation unit 101 includes an input to receive the error signal 112 and an input to receive the system output signal 107. The adaptation unit 101 uses the error signal 112 and the system output signal 107 to monitor the condition of the feedback path 109. The adaptation unit 101 includes at least one algorithm running on a processor to adjust the coefficients of the feedback cancellation filter 102 to match the characteristics of the actual feedback path 109. The rate at which the coefficients are allowed to adjust is called the adaptation rate.

In general, higher adaptation rates improve the ability of the system to adjust the cancellation of feedback from quickly changing feedback paths. However, an adaptation filter with a high adaptation rate often create and allow correlated and tonal signals to pass to the output. Adaptation filters with lower adaptation rates may filter short burst of correlated input signals, but are unable to filter tonal signals, sustained correlated input signals and feedback signals resulting from quickly changing feedback leakage paths. The illustrated system embodiment of FIG. 1B includes an auto regressive (AR) unit 103 configured to provide one or more ratios $B_n$ to the adaptation unit for the basis of adjusting the adaptation rates of the adaptation unit 101 such that entrainment artifacts resulting from correlated and tonal inputs are eliminated.

Figure 2A:
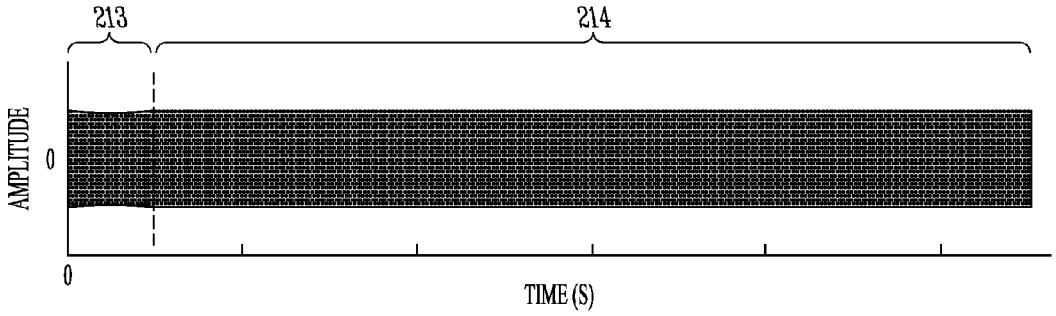
FIGS. 2A and 2B illustrate the response of an adaptive feedback system according one embodiment of the present subject matter with an AR unit enabled, but with the adaptation rates of the adaptation unit held constant.
Figure 2B:
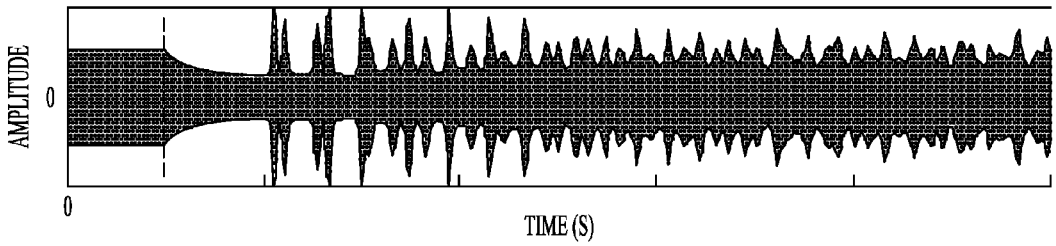

FIGS. 2A-2B illustrate the response of an adaptive feedback system according one embodiment of the present subject matter with an AR unit enabled, but with the adaptation rates of the adaptation unit held constant. The input to the system includes a interval of white noise 213 followed by interval of tonal input 214 as illustrated in FIG. 2A. FIG. 2B illustrates the output of the system in response to the input signal of FIG. 2A. As expected, the system's output tracks a white noise input signal during the initial interval 213. When the input signal changes to a tonal signal at 215, FIG. 2B shows the system is able to output an attenuated signal for a short duration before the adaptive feedback begins to entrain to the tone and pass entrainment artifacts 216 to the output. The entrainment artifacts are illustrated by the periodic amplitude swings in the output response of FIG. 2B.

Figure 3:
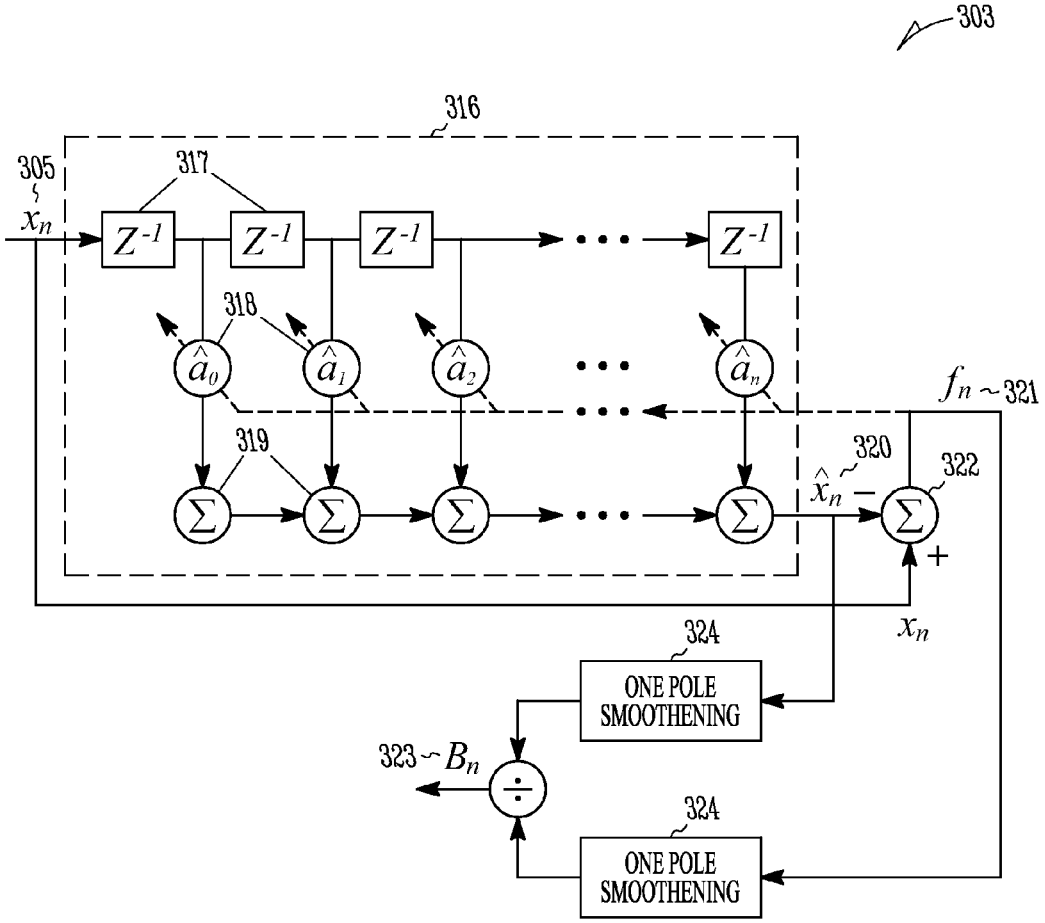
FIG. 3 illustrates an auto regressive (AR) unit according to one embodiment of the present subject matter.

FIG. 3 illustrates an auto regressive (AR) unit 303 according to one embodiment of the present subject matter. In general, the AR unit uses autoregressive analysis to predict the input signal based on past input signal data. As will be shown, the AR unit is adapted to predict correlated and tonal input signals. FIG. 3 shows an input signal, $x_n$, 305 received by an adaptive prediction error filter 316 or all-zero filter. The adaptive prediction error filter 316 includes one or more delay 317 and coefficient 418 elements. Embodiments with more than one delay 317 and coefficient 318 elements include one or more summing junctions 319 used to produce a predicted input signal $\hat{x}_n$ 320. A predicted input error signal, $f_n$, 321 is determined at a summing junction 322 adding the actual input signal 305 to the inverted predicted input signal 320. The adaptive prediction error filter 316 adjusts the coefficient elements 318 of the filter according to an algorithm designed to flatten the spectrum of the filter's output.

The AR unit 303 is further adapted to provide at least one parameter $B_n$ 323 upon which the adaptation unit 101 of FIG. 1B determines adjustments to the adaptation rate of adaptive feedback cancellation unit 102 to prevent the introduction of entrainment artifacts. In various embodiments, the one or more $B_n$ parameters 323 are ratios formed by dividing the predicted input error signal 321 power by the predicted input signal 320 power. In various embodiments, single pole smoothing units 324 are used to determine the one or more $B_n$ parameters 323. In various embodiments, the at least one $B_n$ parameter 323 provides an indication of the absence of correlated or tonal inputs whereby, the adaptation unit 101 uses more aggressive adaptation to adjust the adaptive feedback canceller's coefficients.

The adaptive prediction error filter 316 is able to predict correlated and tonal input signals because it has been shown that white noise can be represented by a $P^{th}$-order AR process and expressed as:

$$x_n = \sum_{i=1}^{P-1} \hat{a}_n(i) x_{n-i} + f_n$$

This equation can also be rearranged as $$f_n = \sum_{i=0}^{P-1} \hat{a}_n(i) x_{n-i}$$

where, $$a_n(k) = \begin{cases} 1 & k = 0 \\ -\hat{a}_n(k) & k = 1, 2, \ldots P \end{cases}$$

and $f_n$ is the prediction error, $a_n(0), \ldots, a_n(i)$ and $a_n(P)$ are AR coefficients. It has been shown that if P is large enough, $f_n$ is a white sequence [41]. The main task of AR modeling is to find optimal AR coefficients that minimize the mean square value of the prediction error. Let $x_n=[X_{n-1} \ldots x_{n-P}]^T$ be an input vector. The optimal coefficient vector $A^*_n$ is known to be the Wiener solution given by $$A^*_n=[a_n(0)^*, a_n(1)^*, \ldots, a_n(P-1)^*]^T=R_n^{-1}r_n$$

where $R_n=E\{x_n x_n^T\}$ input autocorrelation matrix and $r_n=E\{x_n x_n\}$.

The prediction error $f_n$ is the output of the adaptive pre whitening filter $A_n$ which is updated using the LMS algorithm $$A_{n+1} = A_n + \frac{\eta x_n * f_n}{|x_n|^2 + \zeta}$$

where $$f_n=x_n-\hat{x}_n$$

is the prediction error and $$\hat{x}_n=x_n^T A_n$$

is the prediction of $x_n$ the step η size determines the stability and convergence rate of the predicator and stability of the coefficients. It is important to note that $A_n$ is not in the cancellation loop. In various embodiments $A_n$ is decimated as needed. The weight update equation, $$A_{n+1} = A_n + \frac{\eta x_n * f_n}{|x_n|^2 + \zeta}$$

is derived through a minimization of the mean square error (MSE) between the desired signal and the estimate, namely by $$E\{|f_n|^2\}=E\{[x_n-\hat{x}_n]^2\}.$$

The forward predictor error power and the inverse of predictor signal power form an indication of the correlated components in the predictor input signal. The ratio of the powers of predicted signal to the predictor error signal is used as a method to identify the correlation of the signal, and to control the adaptation of the feedback canceller to avoid entrainment. A one pole smoothened forward predictor error, $f_n$, is given by $$\check{f}_n=\beta\check{f}_{n-1}+(1-\beta)|f_n|$$

where β is the smoothening coefficient and takes the values for β<1 and $f_n$ is the forward error given in the equation $$f_n=x_n-\hat{x}_n$$

The energy of the forward predictor $x_n$ can be smoothened by $$\check{x}_n=\beta\check{x}_n+(1-\beta)|\hat{x}_n|.$$

The non-entraining feedback cancellation is achieved by combining these two measures with the variable step size Normalized Least Mean-Square (NLMS) adaptive feedback canceller, where adaptation rate $\mu_n$ is a time varying parameter given by $$W_{n+1} = W_n + \frac{\mu_n u_n * e_n}{|u_n|^2 + \zeta}$$

where $u_n=[u_n, \ldots, u_{n-M+1}]^T$, and $e_n=y_n\hat{y}_n+x_n$ as shown in FIG. 1B and $$B_n = \frac{\hat{f}_n}{\hat{x}_n},$$

and $$u_n=u_0 B_n,$$

where $u_0$ is a predetermined constant adaptation rate decided on the ratio of $\check{f}_n$ and $\check{x}_n$ for white noise input signals. In this method, the adaptation rate of the feedback canceller is regulated by using the autoregressive process block (AR unit). When non-tonal signal (white noise) is present, the forward predictor error is large and the forward predictor output is small leaving the ratio large giving a standard adaptation rate suited for path changes. The AR unit provides a predetermined adaptation rate for white noise input signals. When a tonal input is present, the predictor learns the tonal signal and predicts its behavior resulting in the predictor driving the forward predictor error small and predictor output large. The ratio of the forward predictor error over predictor output is made small, which gives an extremely small adaptation rate, and in turn results in the elimination and prevention of entrainment artifacts passing through or being generated by the adaptive feedback cancellation filter.

Figure 4A:
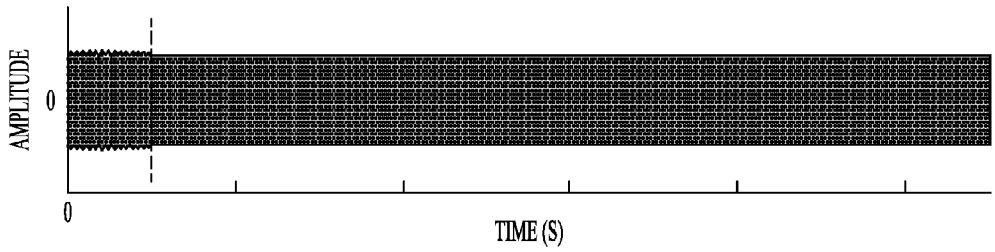
FIGS. 4A, 4B, 4C and 4D illustrate the response of the entrainment avoidance system embodiment of FIG. 1B using the AR unit to adjust the adaptation rates of the adaptation unit to eliminate and prevent entrainment artifacts from the output of the system.
Figure 4B:
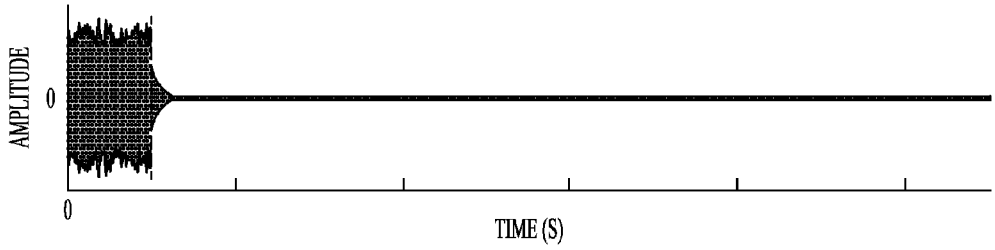
Figure 4C:
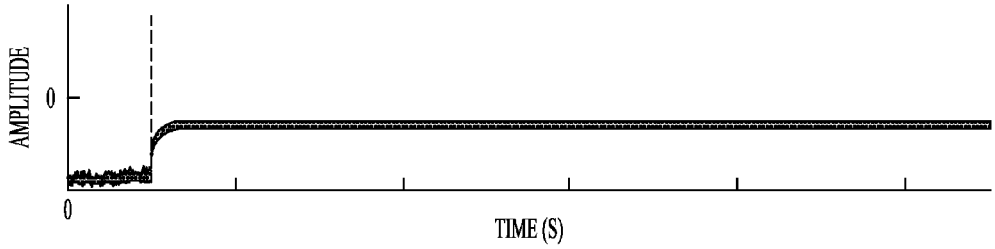
Figure 4D:
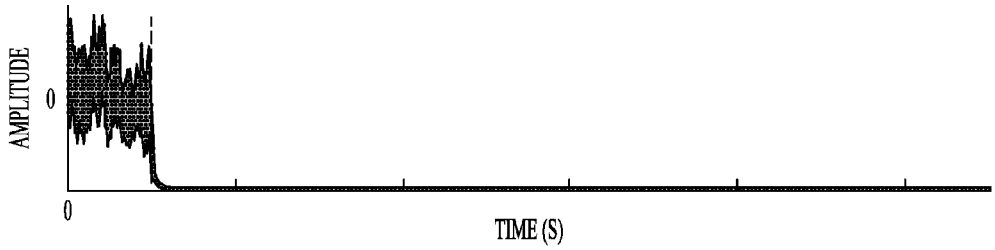

FIG. 4A illustrates the response of the entrainment avoidance system embodiment of FIG. 1B using the AR unit 103 to set the adaptation rates of the adaptation unit 101 to eliminate and prevent entrainment artifacts from the output of the system. FIG. 4A shows the system outputting a interval of white noise followed by a interval of tonal signal closely replicating the input to the system represented by the signal illustrated in FIG. 2A. FIG. 4B illustrates the corresponding temporal response of the predicted input error signal 321 and shows the failure of the adaptive prediction error filter 316 to predict the behavior of a white noise signal. FIG. 4C illustrates the smoothed predicted input signal and shows a small amplitude for the signal during the white noise interval. FIG. 4D illustrates the adaptation rate resulting from the ratio of the predicted input signal error over the predicted input signal. FIG. 4D shows that the adaptation rate is relatively high or aggressive during the interval in which white noise is applied to the system as the predicted input error signal is large and the predicted input signal is comparatively small.

FIGS. 4B and 4C also show the ability of the adaptive prediction error filter 316 to accurately predict a tonal input. FIG. 4B shows a small predicted input error signal during the interval in which the tonal signal is applied to the system compared to the interval in which white noise is applied to the system. FIG. 4C shows a relatively large smoothed predicted input signal during the interval in which the tonal signal is applied to the system compared to the interval in which white noise is applied to the system. In comparing the output signal of the fixed adaptation rate system illustrated in FIG. 2B to the output signal of the entrainment avoidance system illustrated in FIG. 4A, it is observed that the auto recursive unit used to adjust adaptation rates of the adaptation unit eliminates and prevents entrainment artifacts in the output of devices using an entrainment avoidance system according to the present subject matter.

Figure 5:
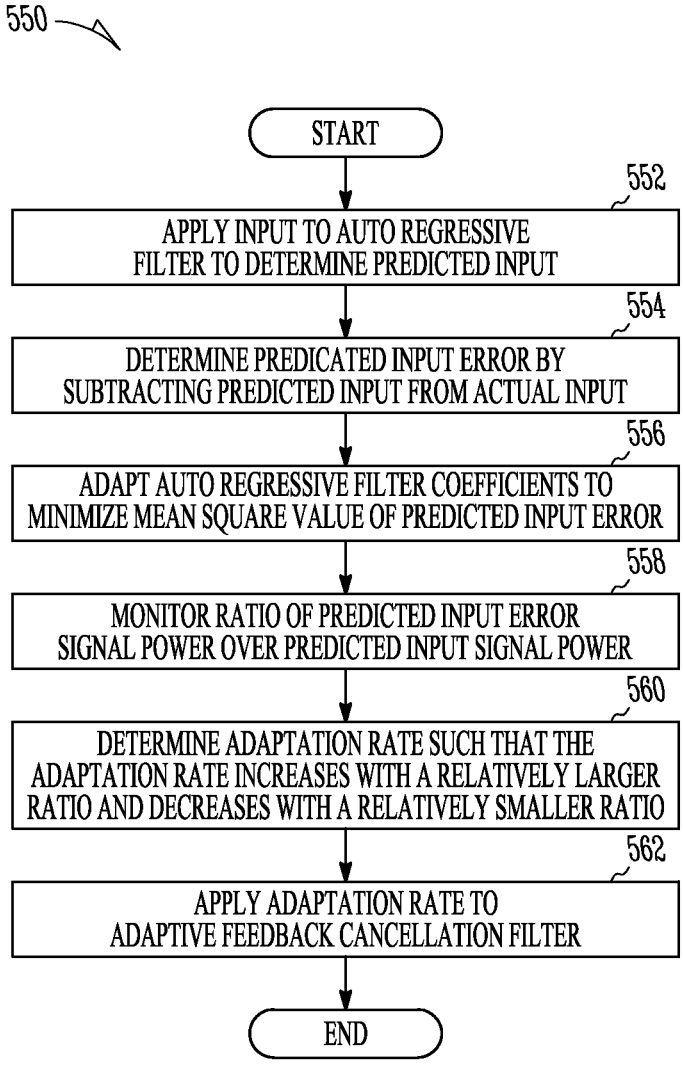
FIG. 5 is a flow diagram showing one example of a method of entrainment avoidance 550 according to the present subject matter.

FIG. 5 is a flow diagram showing one example of a method of entrainment avoidance 550 according to the present subject matter. In this embodiment, the input signal is digitized and a copy of the signal is subjected to an autoregressive filter. The autoregressive filter separates a copy of the input signal into digital delay components. A predicted signal is formed using scaling factors applied to each of the delay components. the scaling factors are based on previous samples of the input signal 552. A predicted signal error is determined by subtracting the predicted signal from the actual input signal 554. The scaling factors of the autoregressive filter are adjusted to minimize the mean square value of the predicted error signal 556. A power ratio of the predicted signal error power and the power of the predicted input signal is determined and monitored 558. Based on the magnitude of the power ratio, the adaptation rate of the adaptive feedback cancellation filter is adjusted 560. As the ratio of the predicted error signal power divided by the signal power rises, the adaptation rate is allowed to rise as well to allow the filter to adapt quickly to changing feedback paths or feedback path characteristics. As the ratio of the predicted error signal power divided by the signal power falls, entrainment becomes more likely and the adaptation rate is reduced to de-correlate entrainment artifacts. Once the adaptation rate is determined, the adaptation rate is applied to the adaptive feedback canceller filter 562. It is to be understood that some variation in order and acts being performed are possible without departing from the scope of the present subject matter.

Various embodiments of methods according to the present subject matter have the advantage of recovering from feedback oscillation. Feedback oscillations are inevitable in practical electro-acoustic system since the sudden large leakage change often causes the system to be unstable. Once the system is unstable it generates a tonal signal. Most tonal detection methods fail to bring back the system to stability in these conditions. methods according to the present subject matter recover from internally generated tones due to the existence of a negative feedback effect. Consider the situation where the primary input signal is non-correlated and the system is in an unstable state and whistling due to feedback. It is likely that the predicting filter has adapted to the feedback oscillating signal and adaptation is stopped. If the input signal is non-correlated, the predictor filter will not be able to model some part of the input signal ($e_n$). This signal portion allows the step size to be non zero making the main adaptive filter converge to the desired signal in small increments. On each incremental adaptation, the feedback canceller comes closer to the leakage and reduces the unstable oscillation. Reducing the internally created squealing tone, decreases the predictor filter's learned profile. As the predictor filter output diverges from the actual signal, the predicted error increases. As the predicted error increases, the power ratio increases and, in turn, the adaptation rate of the main feedback canceller increases bringing the system closer to stability.

This application is intended to cover adaptations and variations of the present subject matter. It is to be understood that the above description is intended to be illustrative, and not restrictive. The scope of the present subject matter should be determined with reference to the appended claim, along with the full scope of equivalents to which the claims are entitled.

What is claimed is:

1. A hearing assistance device, comprising:

an input device configured to produce an input signal;

an output device configured to emit a sound based on an output signal; and a signal processor including an adaptive feedback cancellation filter configured to estimate an acoustic feedback from the output device to the input device, the signal processor configured to:

produce the output signal by processing the input signal;

produce a predicted input signal using an autoregressive analysis;

adjust an adaptation rate of the adaptive feedback cancellation filter to avoid entrainment based on the input signal and the predicted input signal, wherein the signal processor is configured to predict a correlated input signal and a tonal input signal and adjust the adaptation rate in response to the prediction of the correlated input signal or the tonal input signal, and wherein the signal processor is configured to produce a predicted input error signal being a difference between the input signal and the predicted input signal, produce a ratio of a power of the predicted input error signal to a power of the predicted input signal, and adjust the adaptation rate of the adaptive feedback cancellation filter based on the ratio.

2. The device of claim 1, wherein the signal processor comprises an adaptive prediction error filter configured to produce the predicted input signal using the autoregressive analysis, the adaptive prediction error filter having delay elements and coefficients.

3. The device of claim 2, wherein the signal processor is configured to adjust the coefficients of the adaptive prediction error filter to flatten a spectrum of the predicted input signal.

4. The device of claim 2, wherein the signal processor is configured to adjust the coefficients of the adaptive prediction error filter to minimize a mean square value of the predicted input error signal.

5. The device of claim 1, wherein the hearing assistance device comprises a hearing aid, the input device comprises a microphone of the hearing aid, and the output device comprises a receiver of the hearing aid.

6. A hearing aid, comprising:

a microphone;

a receiver configured to emit a sound based an output signal; and a signal processor including an adaptive feedback cancellation filter configured to estimate an acoustic feedback from the receiver to the microphone, the signal processor configured to:

receive an input signal from the microphone;

produce a predicted input signal using an autoregressive analysis;

predict indications of entrainment using the input signal and the predicted input signal;

decrease an adaptation rate of the adaptive feedback cancellation filter to prevent the entrainment in response to one of the indications of the entrainment being predicted;

process the input signal to produce the output signal, wherein the signal processor is configured to predict correlated input signals and tonal input signals as the indications of entrainment, and wherein the signal processor is configured to produce ratios formed by dividing a power of a predicted input error signal by a power of the predicted input signal as the predicted indications of entrainment, the predicted input error signal being a difference between the input signal and the predicted input signal.

7. The hearing aid of claim 6, wherein the signal processor is configured to smooth the predicted input error signal and the predicted input signal prior to producing the ratios.

8. The hearing aid of claim 7, wherein the signal processor is configured to limit the output signal to avoid hard clipping.

9. A method for operating a hearing assistance device having a microphone, a receiver, and an adaptive feedback cancellation filter to estimate an acoustic feedback from the receiver to the microphone, the method comprising:

receiving an input signal from the microphone;

producing a predicted input signal using an autoregressive filter;

predicting indications of entrainment using the input signal and the predicted input signal;

preventing entrainment artifacts from being introduced by adjusting an adaptation rate of the adaptive feedback cancellation filter in response to one of the indications of the entrainment being predicted;

producing a predicted input error signal by subtracting the predicted input signal from the input signal; and adjusting the autoregressive filter to minimize a mean square value of the predicted input error signal, and wherein predicting the indications of entrainment comprises determining a ratio of a power of the predicted input error signal to a power of the predicted input signal.

10. The method of claim 9, wherein producing the predicted input signal comprises:

separating the input signal into delay components; and applying scaling factors to the delay components, and wherein adjusting the autoregressive filter comprises adjusting the scaling factors to minimize a mean square value of the predicted input error signal.

11. The method of claim 9, comprising allowing the adaptation rate to rise when the ratio rises.

12. The method of claim 9, comprising reducing the adaptation rate when the ratio falls.

13. The method of claim 9, comprising smoothing the predicted input error signal and the predicted input signal prior to determining the ratio.

14. The method of claim 9, wherein predicting the indications of entrainment comprises predicting correlated and tonal input signals.

15. The method of claim 14, wherein preventing the entrainment artifacts from being introduced comprises decreasing the adaptation rate of the adaptive feedback cancellation filter in response to the prediction of a correlated input signal of the correlated and tonal input signals.

16. The method of claim 14, wherein preventing the entrainment artifacts from being introduced comprises decreasing the adaptation rate of the adaptive feedback cancellation filter in response to the prediction of a tonal input signal of the correlated and tonal input signals.

* * * * *